US007086248B2

(12) United States Patent
Sakai et al.

(10) Patent No.: US 7,086,248 B2
(45) Date of Patent: Aug. 8, 2006

(54) EJECTOR CYCLE DEVICE

(75) Inventors: Takeshi Sakai, Chiryu (JP); Susumu Kawamura, Anjo (JP)

(73) Assignee: DENSO Corporation, Kariya (JP)

( * ) Notice: Subject to any disclaimer, the term of this patent is extended or adjusted under 35 U.S.C. 154(b) by 482 days.

(21) Appl. No.: 10/673,072

(22) Filed: Sep. 26, 2003

(65) Prior Publication Data

US 2004/0065112 A1 Apr. 8, 2004

(30) Foreign Application Priority Data

Sep. 27, 2002 (JP) ..... 2002-283139

(51) Int. Cl.
*F25B 1/06* (2006.01)

(52) U.S. Cl. ..... 62/500; 62/512

(58) Field of Classification Search ..... 62/470, 62/500, 503, 512

See application file for complete search history.

(56) References Cited

U.S. PATENT DOCUMENTS 3,277,660 A * 10/1966 Kemper et al. ..... 62/116
5,706,666 A * 1/1998 Yamanaka et al. ..... 62/225

FOREIGN PATENT DOCUMENTS

JP 5-149652 6/1993

* cited by examiner

*Primary Examiner*—Melvin Jones
(74) *Attorney, Agent, or Firm*—Harness, Dickey & Pierce, PLC

(57) ABSTRACT

An ejector cycle device includes a gas-liquid separator for separating a refrigerant flowing out of an ejector into gas-phase refrigerant and liquid-phase refrigerant. The gas-liquid separator further separates refrigeration oil from the refrigerant. The refrigeration oil used by the ejector cycle device is less compatible to the refrigerant on the low-pressure side than the compatibility of the refrigeration oil with the refrigerant on a high-pressure side.

13 Claims, 6 Drawing Sheets

EJECTOR CYCLE DEVICE

CROSS REFERENCE TO RELATED APPLICATIONS

This application is based upon, claims the benefit of priority of, and incorporates by reference, the contents of Japanese Patent Application No. 2002-283139 filed Sep. 27, 2002.

FIELD OF THE INVENTION

The present invention relates to generally to ejector cycle devices and more particularly vapor compression type ejector cycle devices.

BACKGROUND OF THE INVENTION

A conventional ejector cycle device is a vapor compression type refrigerator in which a nozzle in its ejector isentropically decompresses and expands a refrigerant to accelerate the refrigerant. A liquid-phase refrigerant separated in a gas-liquid separator is circulated through an evaporator by the pump action of the ejector. A gas-phase refrigerant sucked from the evaporator and the refrigerant injected from the nozzle are mixed while the expansion energy is converted into pressure energy to increase the suction pressure of a compressor.

Then, the refrigerant flowing out of the ejector is separated into the gas-phase refrigerant and the liquid-phase refrigerant by the gas-liquid separator. The liquid-phase refrigerant is subsequently supplied to the side of the evaporator and the gas-phase refrigerant is supplied to the suction side of the compressor. An example of such a refrigerator is disclosed in Japanese Patent Laid-Open Publication No. Hei 5-149652.

Some vapor compression type refrigerators use an expansion valve that causes an isenthalpic (Joule-Thomson) refrigerant expansion. This type of refrigerator utilizes refrigeration oil having a compatibility relative to a carbon dioxide refrigerant at or below a critical pressure that is lower than its compatibility above the critical pressure. An example of such a refrigerator is disclosed in Japanese Patent Laid-Open Publication No. Hei 11-94380.

However, in both vapor compression type refrigerators, refrigeration oil is mixed into the refrigerant and circulated through the cycle to lubricate sliding portions in the compressor. For example, in the ejector cycle device disclosed in Japanese Patent Laid-Open Publication No. Hei 5-149652, the refrigerant flowing out of the ejector is separated into a gas-phase refrigerant and a liquid-phase refrigerant by the gas-liquid separator. The liquid-phase refrigerant is subsequently supplied to the side of the evaporator and the gas-phase refrigerant is supplied to the suction side of the compressor. However, the gas-liquid separator only provides operation of separation between the gas-phase refrigerant and the liquid-phase refrigerant. The gas-liquid separator does not provide separation between the refrigerant and the refrigeration oil. Also, the gas-liquid separator does not supply the suction side of the compressor with the refrigeration oil and the gas-phase refrigerant alone and the evaporator with the liquid-phase refrigerant alone.

When the compressor in the above refrigerator is supplied with a large amount of liquid-phase refrigerant, the pressure inside the compressor may excessively increase and thereby result in damage to the compressor. Further, when the evaporator is supplied with a large amount of refrigeration oil, the refrigeration oil will. adhere to the inner surface of the evaporator and possibly lower the heat transfer rate between the refrigerant and the evaporator and thereby decrease the amount of refrigeration oil returning to the compressor. This may result in problems such as burnt sliding portions in the compressor.

Finally, the gas-liquid separator tends to mix the liquid-phase refrigerant and the refrigeration oil through convection due to such reasons as the dynamic pressure of the incoming refrigerant. Therefore, separating the liquid-phase refrigerant and the refrigeration oil from each other is particularly difficult.

SUMMARY OF THE INVENTION

In view of the foregoing, it is an object of the present invention to provide a new ejector cycle device capable of suppressing the occurrence of the above-mentioned problems.

To achieve the foregoing, an ejector cycle device of vapor compression type for moving heat from a low-temperature side to a high-temperature side includes a compressor for sucking refrigeration oil along with a carbon dioxide refrigerant and compressing the refrigerant; a high-pressure side heat exchanger for radiating heat of a high-pressure refrigerant discharged from the compressor; a low-pressure side heat exchanger for evaporating a low-pressure refrigerant; an ejector having a nozzle for decompressing and expanding the high-pressure refrigerant isentropically, wherein the ejector is for sucking a gas-phase refrigerant evaporated in the low-pressure side heat exchanger by means of a high-speed refrigerant flow injected from the nozzle and converting expansion energy into pressure energy to increase a suction pressure of the compressor ; and a gas-liquid separator for separating a refrigerant flowing out of the ejector into the gas-phase refrigerant and a liquid-phase refrigerant, having a gas-phase refrigerant port connected to a suction side of the compressor and a liquid-phase refrigerant port connected to the low-pressure side heat exchanger. In this configuration, the gas-liquid separator includes a gas-phase refrigerant outlet opening at a gas-phase component area in the gas-liquid separator being in communication with the suction side of the compressor, a liquid-phase refrigerant outlet opening at a liquid-phase component area in the gas-liquid separator being in communication with a refrigerant-inlet side of the low-pressure side heat exchanger, and an oil outlet opening at a liquid-phase component area of the refrigeration oil in the gas-liquid separator being in communication with the suction side of the compressor; and the refrigeration oil uses one whose compatibility relative to the refrigerant on the low-pressure side is smaller than its compatibility relative to the refrigerant on the high-pressure side.

Consequently, even if convection of the liquid-phase refrigerant and the refrigeration oil occurs within the gas-liquid separator, the liquid-phase refrigerant and the refrigeration oil can be separately accumulated in the gas-liquid separator. Thus, even when a difference in density between the liquid-phase refrigerant and the refrigeration oil is small, the liquid-phase refrigerant and the refrigeration oil can be easily separated from each other for extraction, whereby a drop in the heat absorbing capacity of the low-pressure side heat exchanger and insufficient lubrication of the compressor can be prevented from occurring. By extension, it is possible to improve the coefficient of performance and the reliability of the ejector cycle.

The refrigeration oil may be, for example, polyalkylglycol based oil, alkylbenzene based oil, or mineral oil.

Also, the pressure on the side of the high-pressure side heat exchanger may reach or exceeds a critical pressure of the refrigerant.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE INVENTION

The following description of the preferred embodiment(s) is merely exemplary in nature and is in no way intended to limit the invention, its application, or uses.

(First Embodiment)

Figure 1:
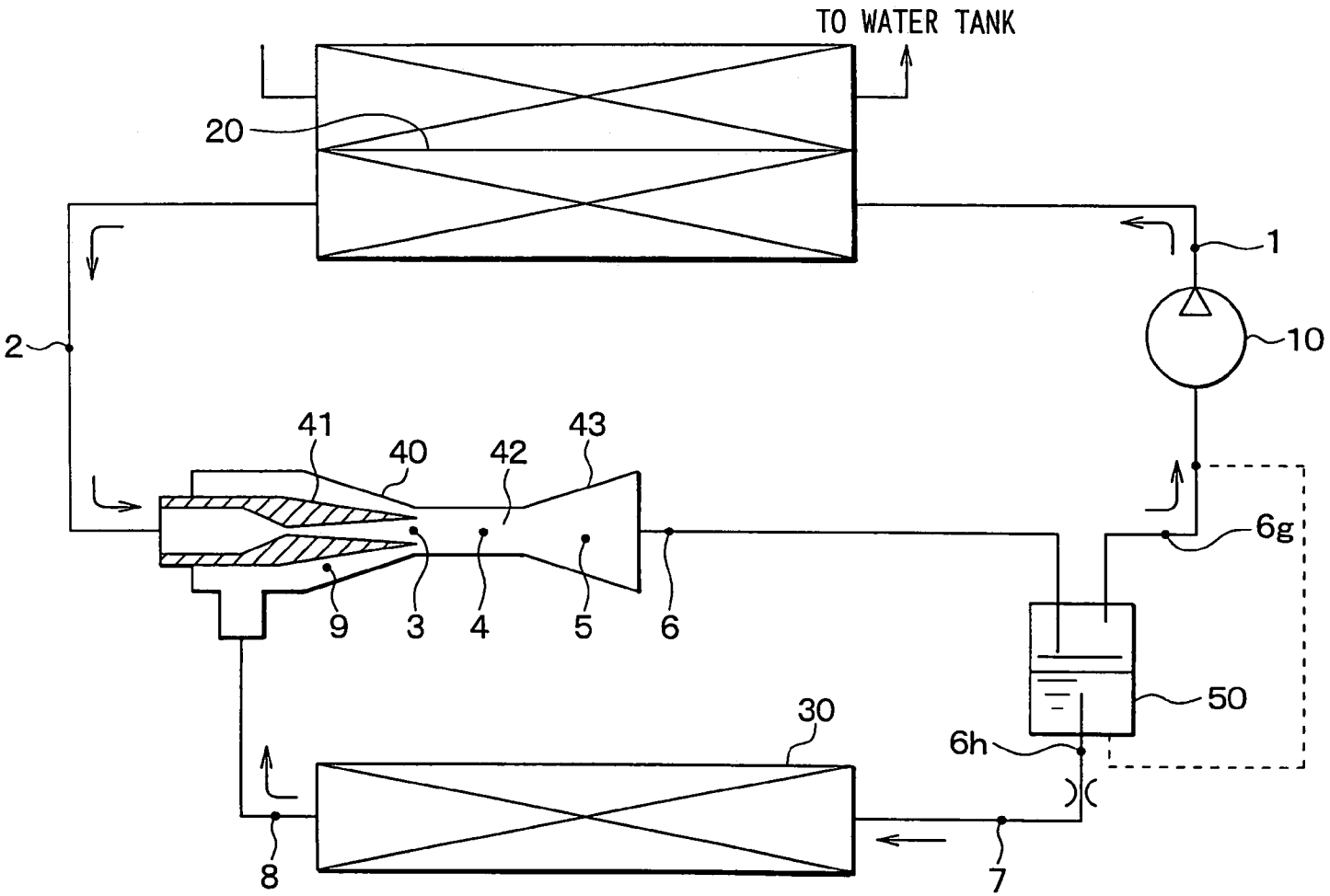
FIG. 1 is a diagram showing the ejector cycle device according to embodiments of the present invention.
Figure 2:
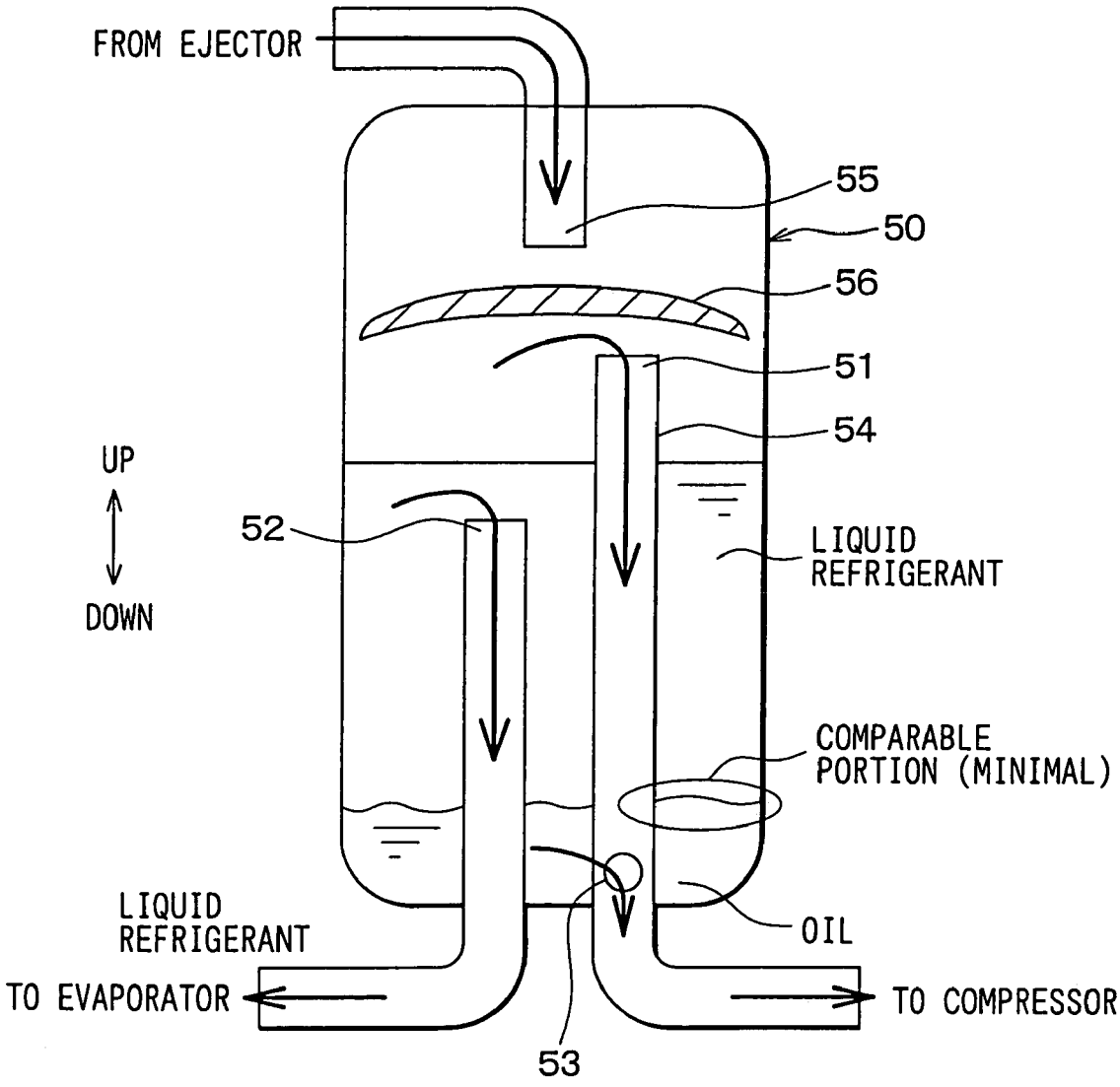
FIG. 2 is a diagram showing a gas-liquid separator according to a first embodiment of the present invention.

Referring to FIGS. 1–2, a first embodiment of the ejector cycle device will be discussed when it is applied to a water heater apparatus. The ejector cycle device generally includes a compressor 10, a radiator 20, an evaporator 30, ejector 40 and a gas-liquid separator 50, each of which will be explained more fully below.

The compressor 10 sucks and compresses a refrigerant. The radiator 20 is a high-pressure side heat exchanger which exchanges heat between the refrigerant discharged from the compressor 10 and water to be heated, thus cooling the refrigerant by heating the water to be heated.

Here, the compressor 10 is driven by an electric motor (not shown). The heating power of the radiator 20 is enhanced by raising the revolution speed of the compressor 10 to thereby increase the flow rate of the refrigerant to be discharged from the compressor 10. The heating power of the radiator 20 is reduced by lowering the revolution speed of the compressor 10 to reduce the flow rate of the refrigerant to be discharged from the compressor 10.

Incidentally, in the present embodiment, carbon dioxide is used as the refrigerant. The compressor 10 pressurizes the refrigerant to or above the critical pressure thereof so that the refrigerant temperature at a refrigerant inlet of the radiator 20 reaches 80° C. to 90° C. or above. The refrigerant thus lowers the refrigerant temperature and decreases in enthalpy as it proceeds from the refrigerant-inlet side to the refrigerant-outlet side 2, with no refrigerant condensation in the radiator 20.

The evaporator 30 is a low-pressure side heat exchanger which exchanges heat between outside air and the liquid-phase refrigerant, thereby evaporating the liquid-phase refrigerant to absorb heat from the outside air. The ejector 40 decompresses and expands a refrigerant to suck the gas-phase refrigerant evaporated in the evaporator 30, and converts the expansion energy into pressure energy to increase the suction pressure of the compressor 10.

The ejector 40 includes a nozzle 41 for converting the pressure energy of an incoming high-pressure refrigerant into speed energy to decompress and expand the refrigerant isentropically. The ejector 40 also includes a mixing portion 42 for sucking the gas-phase refrigerant evaporated in the evaporator 30 by the sucking action of a high-speed refrigerant flow injected from the nozzle 41 and mixing the same with the refrigerant flow injected from the nozzle 41. The ejector 40 also includes a diffuser 43 for mixing the refrigerant injected from the nozzle 41 and the refrigerant sucked from the evaporator 30 and converting the speed energy into pressure energy to increase the pressure of the refrigerant.

Here, the mixing portion 42 exercises the mixing so that the sum of the momentum of the refrigerant flow injected from the nozzle 41 and the momentum of the refrigerant flow sucked from the evaporator 30 into the ejector 40 is conserved. This increases the static pressure of the refrigerant even in the mixing portion 42. Meanwhile, the diffuser 43 converts the dynamic pressure of the refrigerant into a static pressure by its passage gradually increasing in cross section. The ejector 40 thus increases the refrigerant pressure through both the mixing portion 42 and the diffuser 43. For this reason, the mixing portion 42 and the diffuser 43 will be referred to collectively as a pressure increasing portion.

In an ideal ejector 40, the mixing portion 42 increases the refrigerant pressure so as to conserve the sum of the momentum of the two kinds of refrigerant flows and the diffuser 43 increases the refrigerant pressure so as to conserve the energy, so that the enthalpy lowered at the time of decompression and expansion is desirably recovered as pressure energy.

Incidentally, the nozzle 41 of the present embodiment is preferably a Laval nozzle having a throat portion of minimum passage area in the middle of the passage and a divergent portion of gradually increasing inner diameter at the stage subsequent to the throat portion. However, a convergent nozzle having no divergent portion may also be used.

Now, the gas-liquid separator 50 is gas-liquid separating means into which the refrigerant flowing out of the ejector 40 flows, and which separates the incoming refrigerant into the gas-phase refrigerant and the liquid-phase refrigerant for refrigerant accumulation. The gas-liquid separator 50 has a gas-phase refrigerant outlet connected to the suction side of the compressor 10, a liquid-phase outlet connected to the inlet side of the evaporator 30, and an oil outlet connected to the suction side of the compressor 10.

Specifically, as shown in FIG. 2, the gas-phase refrigerant outlet 51 opens at a gas-phase component area in the gas-phase separator 50. The liquid-phase refrigerant outlet 52 opens at a liquid-phase component area in the gas-phase separator 50. The oil outlet 53 opens at a liquid-phase component area of the refrigeration oil in the gas-phase separator 50.

In the present embodiment, the liquid-phase refrigerant has a density smaller than that of the refrigeration oil. The liquid-phase refrigerant outlet 52 is thus located above the oil outlet 53, and the gas-phase refrigerant outlet 51 is located above the liquid-phase refrigerant outlet 52. Incidentally, the outlets 51–53 are each selected based upon parameters such as the pressure-volume loss of the refrigerant piping, the height of the fluid level, the viscosity of the refrigeration oil, etc.

Moreover, the gas-phase refrigerant outlet 51 and the oil outlet 53 are connected to the suction side of the compressor 10. Thus, in the present embodiment, the gas refrigerant pipe 54 is inserted into the gas-liquid separator 50 from below to make the gas-phase refrigerant outlet 51 at its top end, and is provided with the oil outlet 53 at its lower side.

Furthermore, a refrigerant inlet 55 is arranged above the fluid level, i.e., at least on the upstream side of the gas-liquid separator 50. A baffle plate 56 is provided between the fluid level and the refrigerant inlet 55. The baffle plate 56 collides with the refrigerant flowing into the gas-liquid separator 50 from the refrigerant inlet 55 to thereby reduce the dynamic pressure.

Besides, in the present embodiment, for facilitated separation between the liquid-phase refrigerant and the refrigeration oil within the gas-liquid separator 50, the refrigeration oil uses one whose compatibility relative to the refrigerant under the refrigerant state of the low-pressure side, i.e., in the gas-liquid separator 50 is smaller than its compatibility under the refrigerant state of the high-pressure side, such as polyalkylglycol (PGK) based oil.

Incidentally, the compatibility refers to a property of different types of polymers being mixed uniformly, or a maximum amount beyond which mutual separation occurs. The refrigerant state refers to the refrigerant's temperature, pressure, oil content (=the amount of lubricating oil/(the amount of lubricating oil+the amount of refrigerant)), etc.

Figure 3:
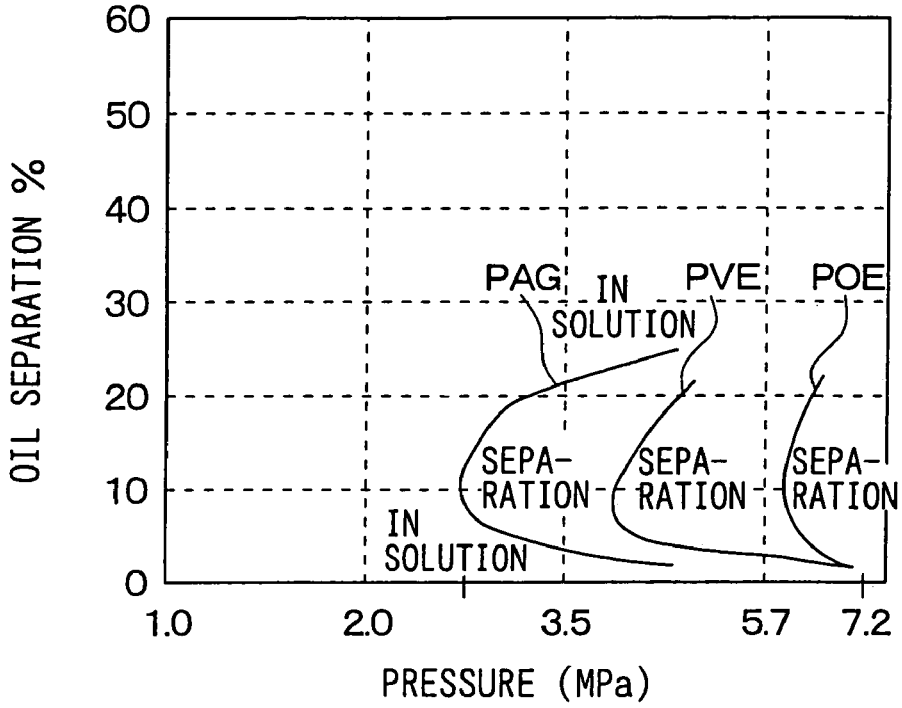
FIG. 3 is a characteristic chart showing the relationship of pressure with oil content and compatible/separate states.
Figure 4:
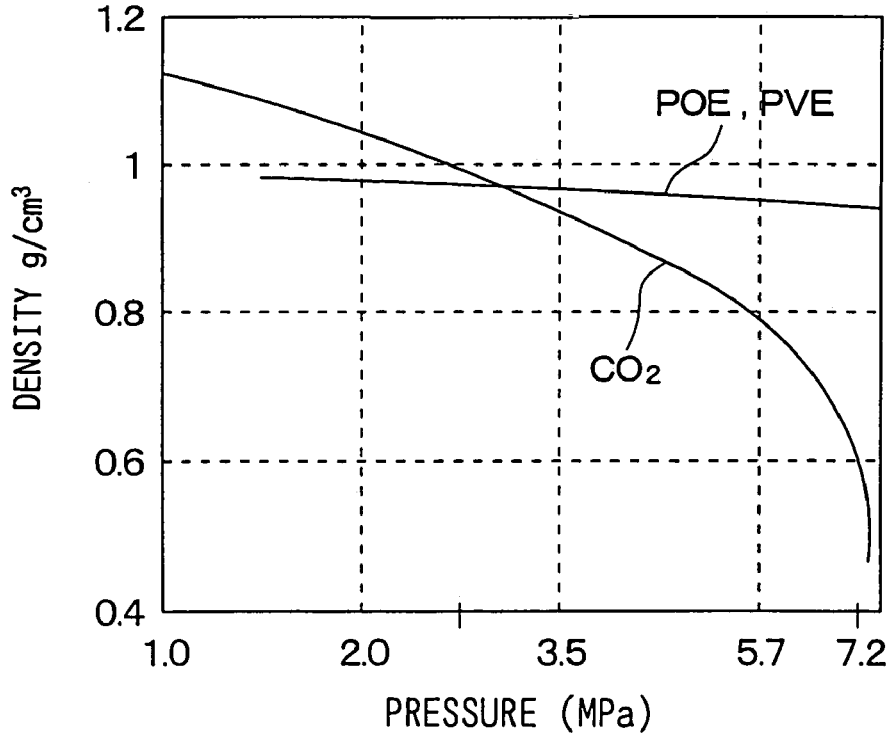
FIG. 4 is a characteristic chart showing the relationship between pressure and density.

Now, FIG. 3 is a characteristic chart showing the relationship of pressure with oil content and compatible/separate states. FIG. 4 is a characteristic chart showing the relationship between the pressure and the density. Since the pressure inside the gas-liquid separator 50 is approximately 3 to 4 MPa and the oil content is approximately 10–20%, it is evident from FIGS. 3 and 4 that the refrigerant and the refrigeration oil in the gas-liquid separator 50 enter the separate state to accumulate the refrigeration oil below.

Referring again to FIGS. 1–2, operation of the first embodiment of the ejector cycle device when it is applied to a water heater apparatus will be discussed. When the compressor 10 is activated, the gas-phase refrigerant is sucked from the gas-liquid separator 50 into the compressor 10, and the compressed refrigerant is discharged to the radiator 20. Having heated the water to be heated and having cooled the refrigerant in the radiator 20, the refrigerant is then decompressed and expanded through the nozzle 41 of the ejector 40 to suck the refrigerant lying in the evaporator 30.

Then, the refrigerant sucked from the evaporator 30 and the refrigerant issuing from the nozzle 41 mix with each other in the mixing portion 42, and return to the gas-liquid separator 50 with their dynamic pressure converted into static pressure by the diffuser 43.

Meanwhile, since the refrigerant in the evaporator 30 is sucked by the ejector 40, the liquid-phase refrigerant flows into the evaporator 30 from the gas-liquid separator 50. The incoming refrigerant absorbs heat from the outside air for evaporation.

Figure 5:
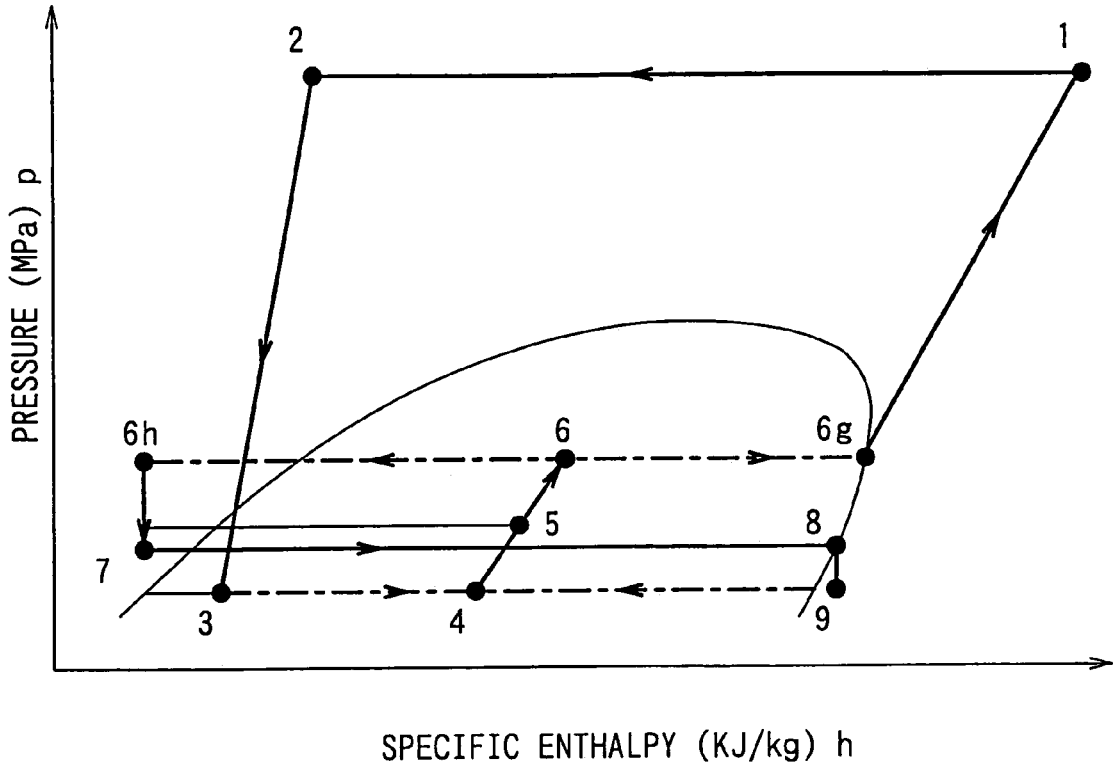
FIG. 5 is a p-h diagram.

Incidentally, FIG. 5 is a p-h diagram showing the operation of the ejector cycle device according to the present embodiment. The numerals shown in FIG. 5 represent the states of the refrigerant at positions shown numbered in FIG. 1.

In the present embodiment, the refrigeration oil used is less compatible with the refrigerant on the low-pressure side than it is with the refrigerant on the high-pressure side. Thus, even if convection of the liquid-phase refrigerant and the refrigeration oil occurs within the gas-liquid separator 50, the liquid-phase refrigerant and the refrigeration oil are separately accumulated in the gas-liquid separator 50.

Consequently, even when a difference in density between the liquid-phase refrigerant and the refrigeration oil is small, the liquid-phase refrigerant and the refrigeration oil can be easily separated from each other for extraction. This can prevent a drop in the heat absorbing capacity of the evaporator 30 and insufficient lubrication of the compressor 10 from occurring. By extension, it is possible to improve the coefficient of performance and the reliability of the ejector cycle.

(Second Embodiment)

Figure 6:
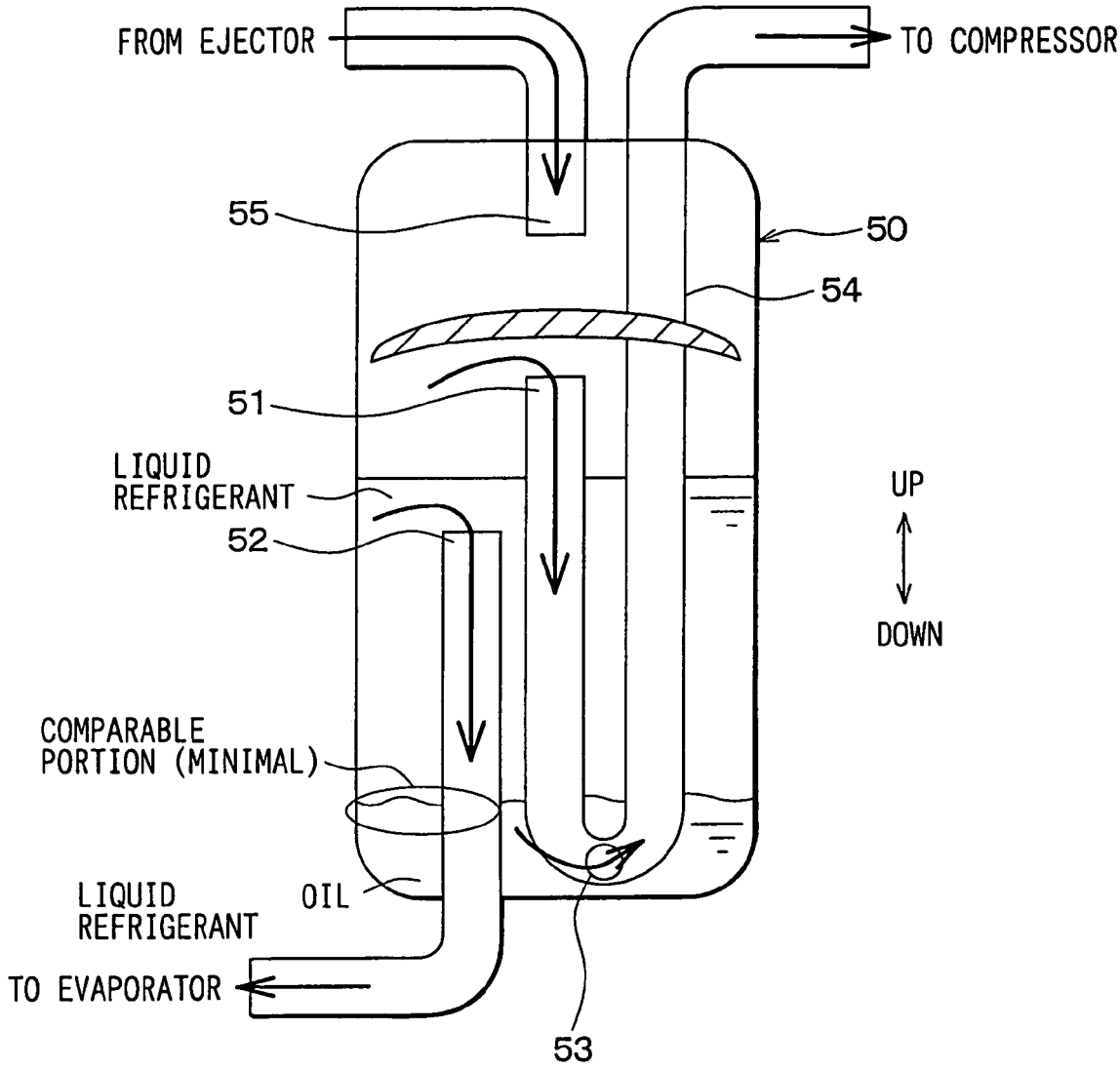
FIG. 6 is a diagram showing the gas-liquid separator according to a second embodiment of the present invention.

In the gas-liquid separator 50 according to the first embodiment of the injector cycle device, the gas refrigerant pipe 54 is inserted into the gas-liquid separator 50 from below. In the present embodiment, as shown in FIG. 6, the gas refrigerant pipe 54 is given a generally U shape and is provided with the oil outlet 53 in the bend, so that the gas refrigeration pipe 54 is inserted to the gas-liquid separator 50 from above.

(Third embodiment)

Figure 7:
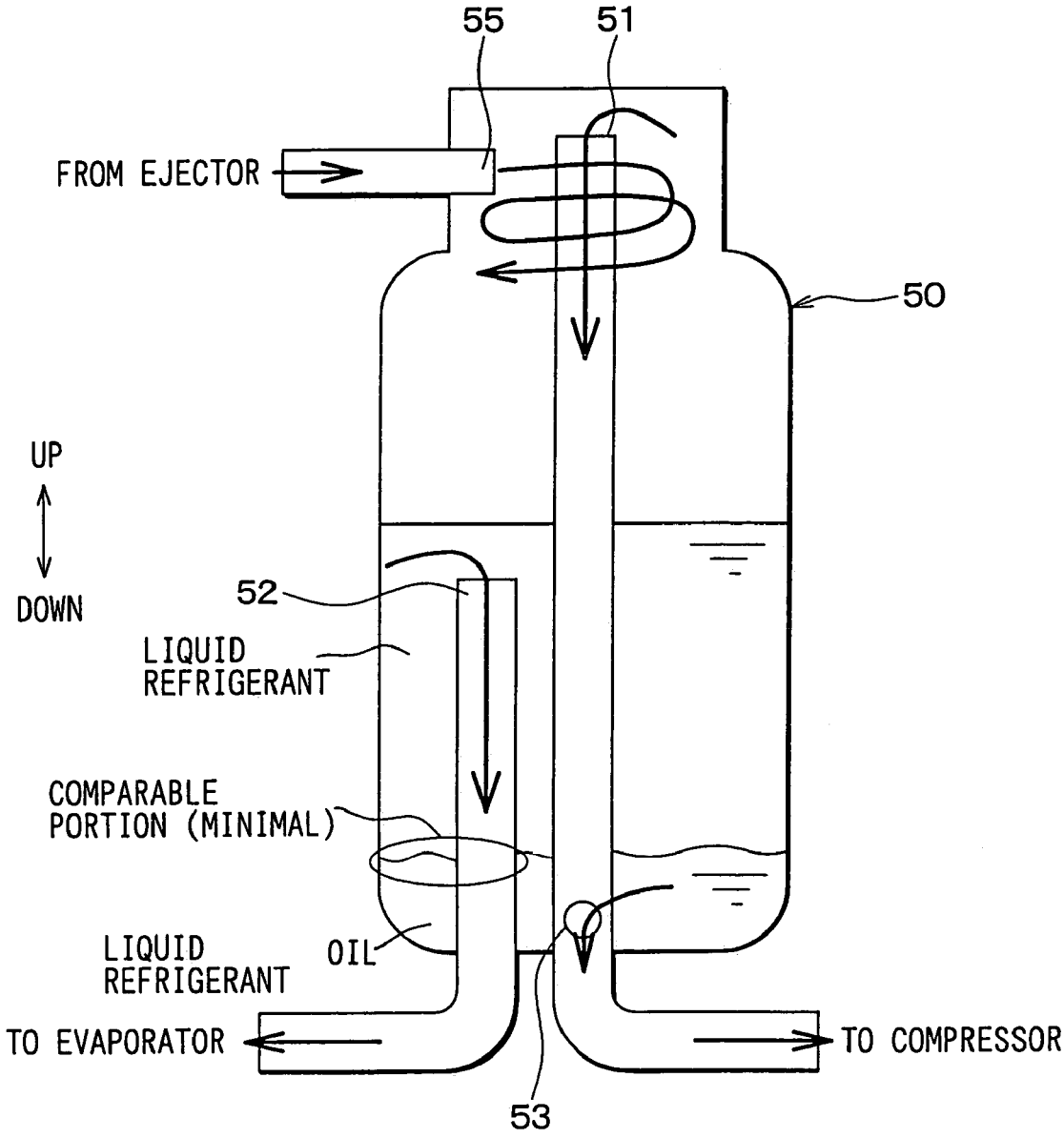
FIG. 7 is a diagram showing the gas-liquid separator according to a third embodiment of the present invention.

Referring now to FIG. 7, a third embodiment of the gas-liquid separator will be discussed. Here, the baffle plate 56 is removed from the gas-liquid separator 50. The flow direction of the refrigerant flowing from the refrigerant inlet 55 into the gas-liquid separator 50 corresponds to a tangential direction of the upper inner wall of the gas-liquid separator 50 so that the refrigerant flowing into the gas-liquid separator 50 swirls in the upper part of the gas-liquid separator 50 to thereby provide centrifugal separation between the refrigerant and the refrigeration oil.

(Alternative Modifications)

In the foregoing embodiments, the polyalkylglycol (PAG) based oil is adopted as the refrigeration oil. However, the present invention is not limited thereto. For example, alkylbenzene based (AB) oil, polyvinylether (PVE) based oil, mineral oil, and the like may be adopted. Further, the condition by which the compatibility of the refrigeration oil with the refrigerant on the low-pressure side is less than the compatibility of the refrigeration oil with the refrigerant on the high-pressure side can be satisfied by the case of no compatibility on the low-pressure side.

Moreover, while in the foregoing embodiments the present invention is applied to a water heater apparatus, the application of the present invention is not limited thereto. For example, the present invention may be applied to air conditioning apparatuses, refrigerators, freezers, and so on.

Moreover, in the foregoing embodiments, the refrigerant is carbon dioxide and the refrigerant pressure on the high-pressure side is at or above the critical pressure. However, the present invention is not limited thereto. For example, the refrigerant pressure on the high-pressureside maybe below the critical pressure.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ejector cycle device of vapor compression type for moving heat from a low-temperature side to a high-temperature side, the ejector cycle device comprising:

a compressor for sucking refrigeration oil along with a carbon dioxide refrigerant, and compressing the refrigerant;

a high-pressure side heat exchanger for radiating heat of a high-pressure refrigerant discharged from the compressor;

a low-pressure side heat exchanger for evaporating a low-pressure refrigerant;

an ejector having a nozzle for decompressing and expanding the high-pressure refrigerant isentropically, the ejector sucking a gas-phase refrigerant evaporated in the low-pressure side heat exchanger by means of a high-speed refrigerant flow injected from said nozzle and converting expansion energy into pressure energy to increase a suction pressure of the compressor; and a gas-liquid separator for separating a refrigerant flowing out of the ejector into the gas-phase refrigerant and a liquid-phase refrigerant, wherein the gas-liquid separator includes:

a gas-phase refrigerant port connected to a suction side of the compressor and a liquid-phase refrigerant port connected to the low-pressure side heat exchanger;

a gas-phase refrigerant outlet opening at a gas-phase component area in the gas-liquid separator, the gas-phase refrigerant outlet being in communication with the suction side of said compressor;

a liquid-phase refrigerant outlet opening at a liquid-phase component area in the gas-liquid separator, the liquid-phase refrigerant outlet being in communication with a refrigerant-inlet side of the low-pressure side heat exchanger; and an oil outlet opening at a liquid-phase component area of the refrigeration oil in the gas-liquid separator, the oil outlet being in communication with the suction side of the compressor, wherein a refrigeration oil compatibility relative to the refrigerant on the low-pressure side is less than a refrigeration oil compatibility relative to the refrigerant on the high-pressure side.

2. The ejector cycle device according to claim 1, wherein the refrigeration oil is polyalkylglycol based oil.

3. The ejector cycle device according to claim 1, wherein the refrigeration oil is alkylbenzene based oil.

4. The ejector cycle device according to claim 1, wherein the refrigeration oil is mineral oil.

5. The ejector cycle device according to claim 4, wherein a pressure on the side of the high-pressure side heat exchanger reaches or exceeds a critical pressure of the refrigerant.

6. The ejector cycle device according to claim 3, wherein a pressure on the side of the high-pressure side heat exchanger reaches or exceeds a critical pressure of the refrigerant.

7. The ejector cycle device according to claim 2, wherein a pressure on the side of the high-pressure side heat exchanger reaches or exceeds a critical pressure of the refrigerant.

8. The ejector cycle device according to claim 1, wherein a pressure on the side of the high-pressure side heat exchanger reaches or exceeds a critical pressure of the refrigerant.

9. An ejector cycle device of vapor compression type for moving heat from a low-temperature side to a high-temperature side, the ejector cycle device comprising:

a compressor for sucking refrigeration oil along with a refrigerant and compressing the refrigerant;

a high-pressure side heat exchanger for radiating heat of a high-pressure refrigerant discharged from the compressor;

a low-pressure side heat exchanger for evaporating a low-pressure refrigerant;

an ejector having a nozzle for decompressing and expanding the high-pressure refrigerant isentropically, the ejector sucking a gas-phase refrigerant evaporated in said low-pressure side heat exchanger by means of a high-speed refrigerant flow injected from said nozzle and converting expansion energy into pressure energy to increase a suction pressure of said compressor; and a gas-liquid separator for separating a refrigerant flowing out of said ejector into the gas-phase refrigerant and a liquid-phase refrigerant, the gas-liquid separator having a gas-phase refrigerant port connected to a suction side of said compressor and a liquid-phase refrigerant port connected to said low-pressure side heat exchanger, wherein a refrigeration oil compatibility relative to the refrigerant on the low-pressure side is less than a refrigeration oil compatibility relative to the refrigerant on the high-pressure side.

10. A gas-liquid separator for an ejector cycle device of vapor compression type for moving heat from a low-temperature side to a high-temperature side, wherein the gas-liquid separator separates incoming refrigerant into a gas-phase refrigerant and a liquid-phase refrigerant, the gas-liquid separator comprising:

a refrigerant inlet disposed above a gas-liquid separator fluid level, wherein the refrigerant inlet is in fluid communication with a pressure increasing portion of a nozzle to thereby deliver statically pressurized incoming refrigerant;

a liquid-phase refrigerant port disposed below the gas-liquid separator fluid level, wherein the liquid-phase refrigerant port is in fluid communication with a low-pressure side heat exchanger to thereby deliver the liquid-phase refrigerant separated from the statically pressurized incoming refrigerant to a low-pressure side heat exchanger; and a gas-phase refrigerant outlet disposed within a gas-phase component area, wherein the gas-phase refrigerant outlet includes an oil outlet disposed within a liquid-phase component area and below the liquid-phase refrigerant port for separating refrigerant oil from the liquid-phase refrigerant, wherein the gas-phase refrigerant outlet is in fluid communication with a compressor to thereby deliver gas-phase refrigerant and refrigerant oil separated from the statically pressurized incoming refrigerant to a high-pressure side heat exchanger.

11. The gas-liquid separator according to claim 10, wherein a refrigeration oil compatibility relative to the refrigerant on a low-pressure side is less than a refrigeration oil compatibility relative to the refrigerant on a high-pressure side.

12. The gas-liquid separator according to claim 10, wherein a gas refrigerant pipe including gas-phase refrigerant outlet is generally U-shaped and the oil outlet is disposed within a bend portion of the gas refrigerant pipe.

13. The gas-liquid separator according to claim 10, wherein the refrigerant inlet delivers the incoming refrigerant in a flow direction that corresponds to a tangential direction of an upper inner wall so that the incoming refrigerant swirls in an upper gas-liquid separator portion to thereby provide centrifugal separation between the refrigeration oil and the liquid-phase refrigerant.

* * * * *